United States Patent [19]

Suga

[11] Patent Number: 4,931,834

[45] Date of Patent: Jun. 5, 1990

[54] IMAGE FORMING APPARATUS

[75] Inventor: Takayuki Suga, Tokyo, Japan

[73] Assignee: Kabushiki Kaisha Toshiba, Kawasaki, Japan

[21] Appl. No.: 426,592

[22] Filed: Oct. 25, 1989

[30] Foreign Application Priority Data

Oct. 31, 1988 [JP] Japan ..... 63-273056

[51] Int. Cl.[5] ..... G03G 15/00; G03G 21/00

[52] U.S. Cl. ..... 355/200; 355/296

[58] Field of Search ..... 355/211, 296, 269, 299, 355/200, 216; 74/398, 406, 810, 421 A

[56] References Cited

U.S. PATENT DOCUMENTS

| | | | |
|---|---|---|---|
| 4,401,385 | 8/1983 | Katayama et al. | 355/299 |
| 4,555,173 | 11/1985 | Iseki et al. | 355/200 |
| 4,769,669 | 9/1988 | Watanabe | 355/200 |
| 4,806,968 | 2/1989 | Watanabe et al. | 355/200 |

FOREIGN PATENT DOCUMENTS

| | | | |
|---|---|---|---|
| 0156084 | 8/1985 | Japan | 355/299 |
| 60-178478 | 9/1985 | Japan . | |
| 0009381 | 1/1987 | Japan | 355/299 |

*Primary Examiner*—A. T. Grimley
*Assistant Examiner*—William J. Royer
*Attorney, Agent, or Firm*—Foley & Lardner, Schwartz, Jeffery, Schwaab, Mack, Blumenthal & Evans

[57] ABSTRACT

An image forming apparatus includes a rotatable image carrier, a motor for rotating the carrier forwardly and reversely, and transmission mechanisms for transmitting the drive force of the motor to a driven portion other than the image carrier when the carrier is being rotated forwardly and for cutting off the driving force from the driven portion when the carrier is being rotated reversely. Each transmission mechanism has a first gear rotated forwardly and reversely in synchronism with the image carrier by the motor, a second gear engaging with the driven portion, an intermediate gear in mesh with the first gear and capable of meshing with the second gear, and an arm for supporting the intermediated gear. While first gear is forwardly rotated, the intermediate gear is subjected a force in the direction for engagement with the second gear. While the first gear is rotated reversely, the intermediate gear is subjected a force in the direction for disengagement from the second gear.

8 Claims, 7 Drawing Sheets

IMAGE FORMING APPARATUS

BACKGROUND OF THE INVENTION

1. Field of the Invention

The present invention relates to an image forming apparatus, such as an electronic copying machine, provided with a driving force transmission mechanism for transmitting the driving force of a motor, used to drive an image carrier, for example, to a fixing unit or a sheet feed unit.

2. Description of the Related Art

Conventional desk-type copying machines employ a drive system in which a plurality of driven parts are driven by means of one motor, in order to enjoy reduction in power consumption, size, weight, and costs. In such a system, a single motor is used to drive an image carrier, such as a photosensitive drum, a heat roller of a fixing unit, and aligning rollers of a sheet feed unit. In this case, the driving force of the motor for driving the image carrier is transmitted to the fixing unit or the sheet feed unit by means of a driving force transmission mechanism, which includes a belt unit and a gear train.

In the image forming apparatuses of this type, residual toner particles left on the surface of the image carrier during image forming operation are removed in the following manner, by means of a cleaning unit located on the lower-course side of an image transfer position of the carrier, with respect to the rotating direction thereof. First, a cleaning blade, for use as a cleaning member, is held against the surface of the carrier in forward rotation, during the image formation, whereby the residual toner particles are scraped off. When the image forming operation is finished, the rotation of the carrier is stopped. Then, the blade is disengaged from the carrier surface, and at the same time, the carrier is rotated in reverse for a predetermined angle. As a result, the residual toner particles left between the end edge of the blade and the carrier are moved from the position of engagement between the blade and the carrier to the upper-course side of the carrier with respect to the direction of forward rotation. Thereafter, a subsequent cycle of image forming operation is performed, and residual toner particles are removed in the same manner as aforesaid. Production of black streaks is prevented by cleaning the image carrier through the operation of the carrier and the cleaning unit.

Thus, the image forming apparatuses of this type are generally constructed so that a main motor is driven in reverse to rotate the image carrier in reverse for a predetermined amount after the end of a final cycle of image forming operation. Some of these apparatuses are not provided with any means for preventing the driving force from being transmitted to the side of driven members other than the carrier, that is, the side of the fixing unit or the sheet feed unit, while the main motor is reversely rotating. In other apparatuses, the rotatory force of the main motor can be transmitted only in one direction so that the driving force cannot be transmitted to the side of the other driven members while the motor is reversely rotating.

In the former apparatuses, however, if paper sheets are jammed in the course of transportation, they return to the supply side when the image carrier rotates in reverse, causing users a great deal of frustration.

In the latter apparatuses, moreover, the driving force transmission mechanism is expensive.

SUMMARY OF THE INVENTION

An object of the present invention is to provide an image forming apparatus which can transmit a driving force to driven members other than an image carrier when the carrier is being rotated forward and can cut off the driving force from the driven members when the carrier is being rotated in reverse, despite the use of a simple, low-priced arrangement.

Another object of the present invention is to provide an image forming apparatus capable of easily dividing a driving force transmission mechanism.

In order to achieve the above objects, an apparatus according to the present invention comprises:

a rotatable image carrier; drive means including a drive source, for rotating the image carrier in a forward direction for image formation, and rotating the carrier in reverse for a predetermined amount after the image formation; and driving force transmission means for transmitting the driving force of the drive source to a driven portion other than the image carrier when the carrier is being rotated forward, and for cutting off the driving force from the driven portion when the carrier is being rotated in reverse, the transmission means including a first gear rotated forwardly and reversely in synchronism with the image carrier by means of the drive source, a second gear in engagement with the driven portion, an intermediate gear in mesh with the first gear and capable of meshing with the second gear, and supporting means for supporting the intermediate gear so that force in the direction for engagement with the second gear acts on the intermediate gear while the first gear is rotating forward, and that a force in the direction for disengagement from the second gear acts on the intermediate gear while the first gear is rotating in reverse.

The image forming apparatus according to the present invention further comprises a first unit holding the image carrier and the drive means and a second unit holding the driven portion, the first unit being shiftable between an operative position for image formation, in which the first unit is in engagement with the second unit, and a nonoperative position, in which the first unit is disengaged from the second unit. The first gear and the intermediate gear of the driving force transmission means are attached to the first unit, and the second gear is attached to the second unit. The driving force transmission means is designed so that the gear and the second gear are disengaged from each other when the first unit is shifted to the nonoperative position.

BRIEF DESCRIPTION OF THE DRAWINGS

FIGS. 1 to 7D show an image forming apparatus according to an embodiment of the present invention, in which:

FIG. 1 is a perspective view showing a general arrangement of the apparatus;

FIG. 2 is a longitudinal sectional view of the apparatus;

FIG. 3 a perspective view of the apparatus with its upper and lower units disengaged;

FIG. 4 is a sectional view showing a drive system of the apparatus;

FIG. 5 is a plan view of the drive system;

FIG. 6 is a front view showing a driving force transmission mechanism of the drive system; and FIGS. 7A to 7D are schematic views individually showing cleaning processes of a cleaning unit.

DETAILED DESCRIPTION OF THE PREFERRED EMBODIMENTS

An embodiment of the present invention will now be described in detail with reference to the accompanying drawings.

Figure 1:
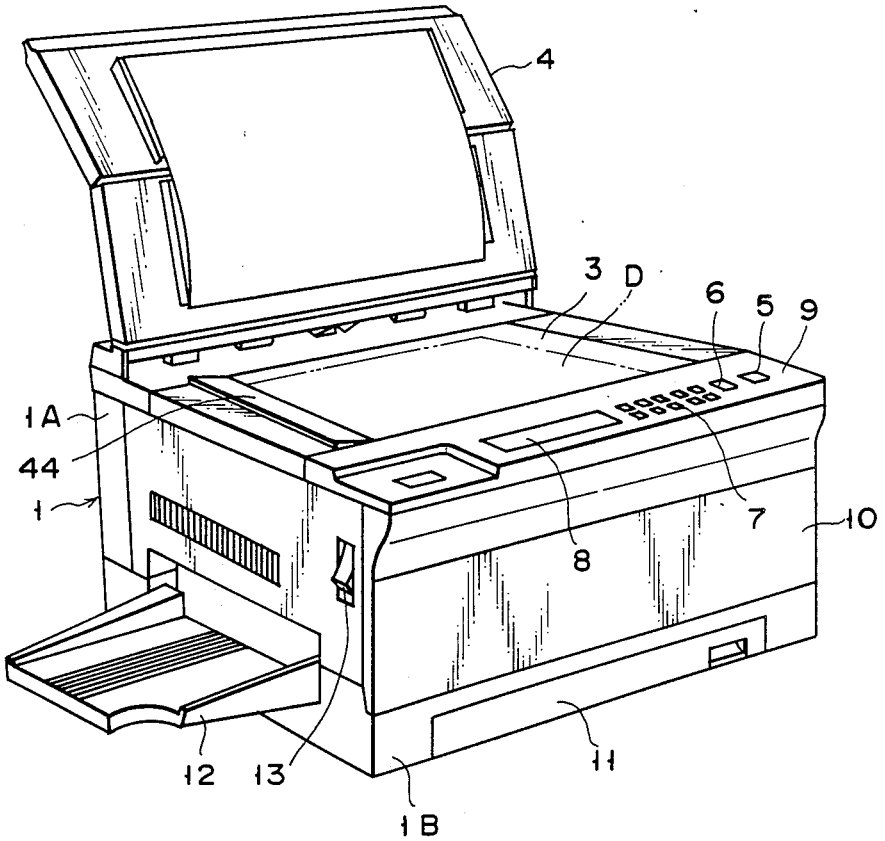
Figure 2:
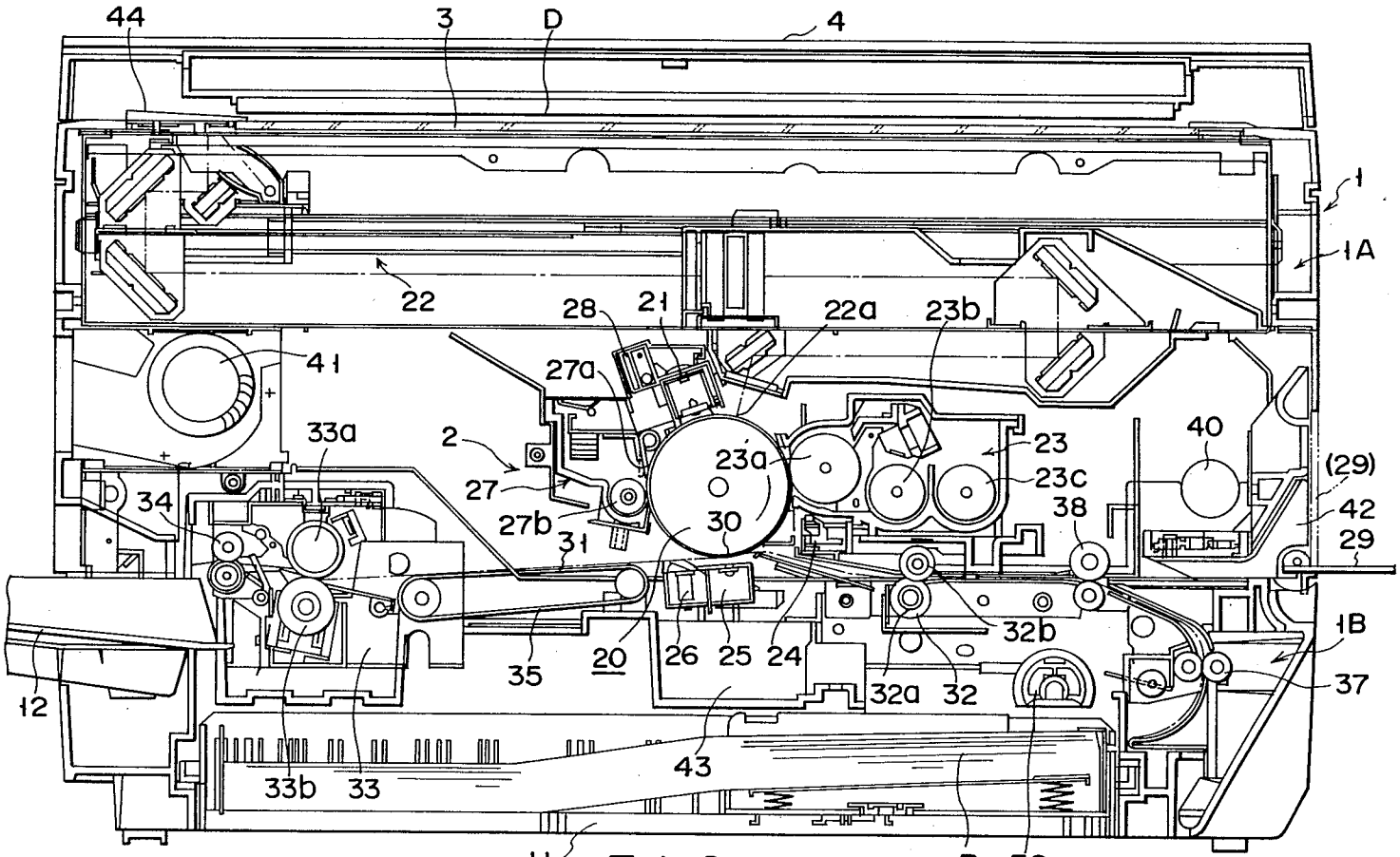

As is shown in FIGS. 1 and 2, an image forming apparatus has housing 1, in which is arranged image forming assembly means 2 for charging, exposure, transfer, separation, cleaning, de-electrification, fixation, etc. Original table 3 (hereinafter referred to as platen glass) for carrying original D is mounted on the top face of housing 1. Original cover 4 is swingably mounted on the top face of housing 1. It is used to press down original D when set on platen glass 3. Further, control panel 9, which is provided with copy key 5, clear/stop key 6, numerical pad 7, display unit 8, etc., is located at the front end of the top face of housing 1.

Swingable front cover 10 is provided on the front face of apparatus housing 1, and sheet cassette 11, which contains paper sheets P, such as ordinary paper, to be fed to image forming assembly means 2, is attached to the lower portion of the front face. Tray 12 for collecting fixed sheets P and power switch 13 are arranged on the left-hand side of housing 1.

Image forming assembly means 2 is constructed as follows. Photosensitive drum 20, for use as an image carrier, is arranged substantially in the central portion of the interior of housing 1. Drum 20 is surrounded by main charger 21, exposure region 22*a* of exposure unit 22, developing unit 23, pre-transfer exposure unit 24, transfer unit 25, separation unit 26, cleaning unit 27, and de-electrification unit 28, which are arranged successively in the rotating direction of the drum.

Sheet path 31 is defined inside apparatus housing 1. It serves to guide paper sheets P, automatically fed from sheet cassette 11 or manually fed through sheet-bypass table 29, to tray 12 on the left-hand side of housing 1 via image transfer region 30 between photosensitive drum 20 and transfer unit 25.

Aligning roller pair 32 is located on the upper-course side of sheet path 31 with respect to image transfer region 30, while fixing unit 33 and exit roller pair 34 are arranged on the lower-course side. Conveyor belt unit 35 is disposed between separation unit 26 and fixing unit 33.

Paper-supply roller 36, used to pick up paper sheets P one by one, and separation/transportation means 37 are arranged in the vicinity of sheet cassette 11. Means 37, which includes a feed roller and a separation roller, receives sheets P picked up by paper-supply roller 36, and feeds them into a first branch path, which constitutes the upper-course side of sheet path 31. A pair of feed rollers 38 for manual feed are arranged at the junction of the first branch path and a second branch path for manual feed.

Figure 3:
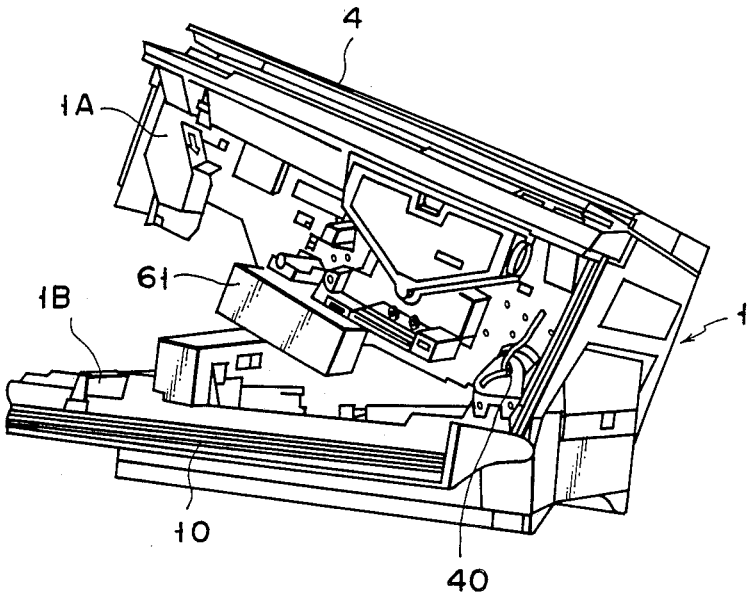

Apparatus housing 1 is divided in two, upper and lower units IA and lB, which adjoin each other substantially along sheet path 31. Upper unit lA can rock about 25° around pivot 40 between two positions. One position is an operative position in which units 1A and 1B are in engagement with each other, as shown in FIG. 1, and the other position is a nonoperative position in which units lA and lB are disengaged, as shown in FIG. 3. Pivot 40 is formed of a shaft portion of a torsion bar which continually urges upper unit lA toward the nonoperative position.

As is shown in FIG. 2, cooling fan 41 is located above fixing unit 33, and sheet-bypass guide 42 for guiding manually fed sheets is arranged at the right end of housing 1 High-voltage transformer 43 is located below transfer unit 25 and separation unit 26. As seen from FIG. 1, a scale 44, which serves as a standard for setting original D, is arranged on one end of platen glass 3.

Figure 4:
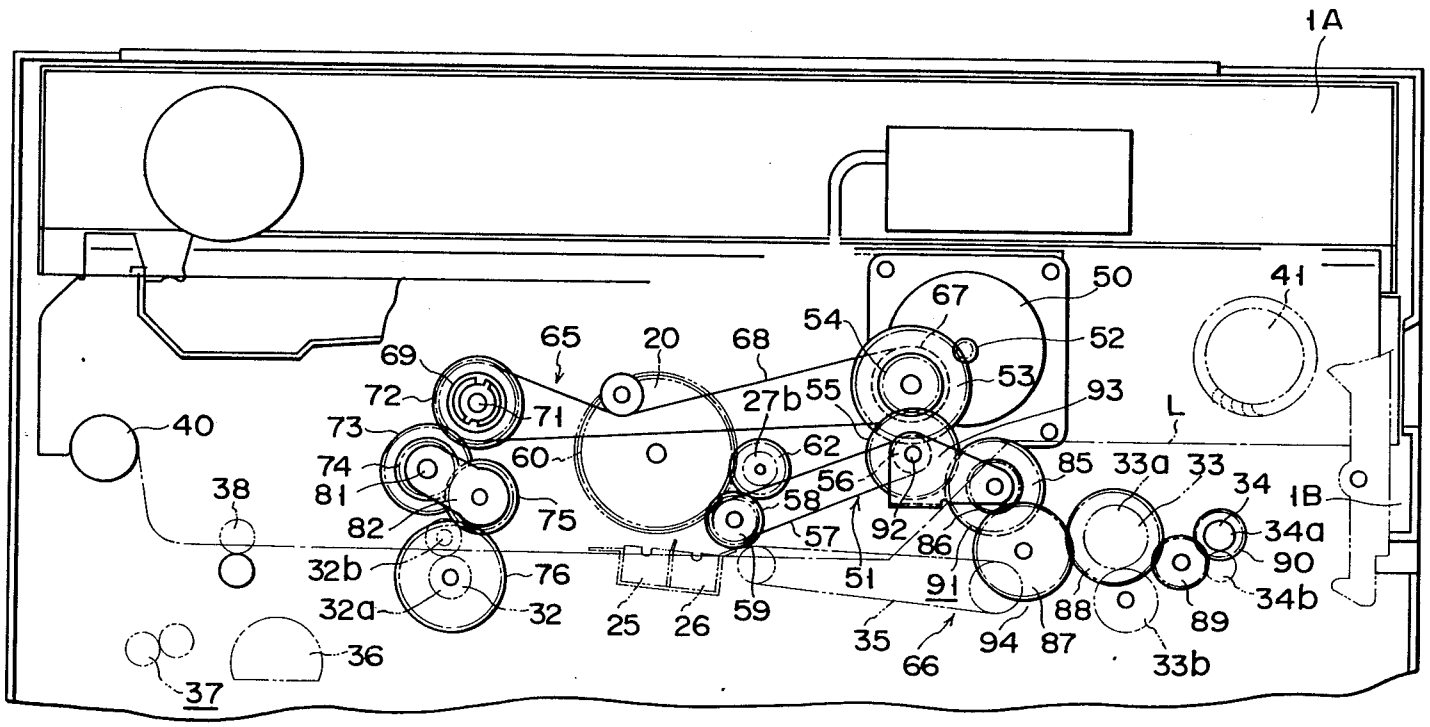
Figure 5:
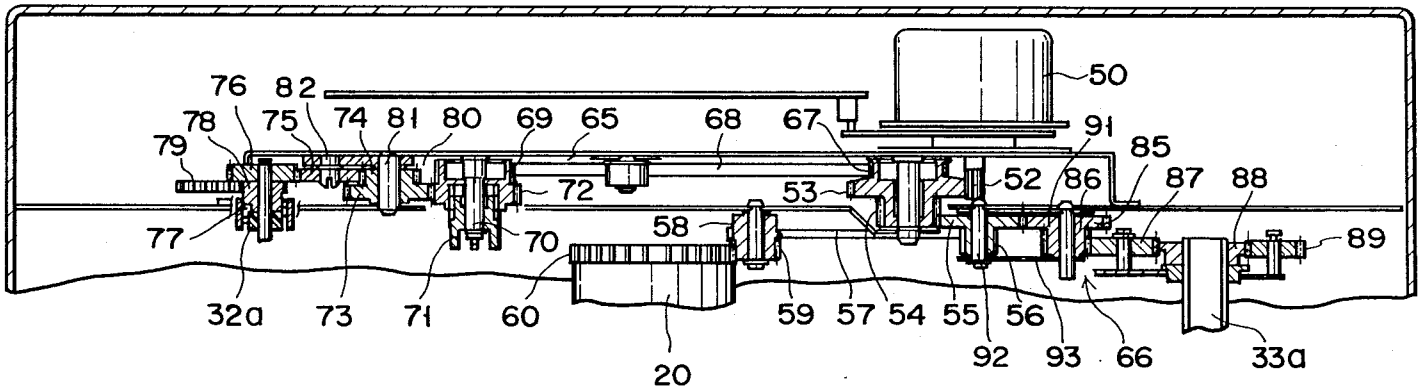

FIGS. 4 and 5 show a drive mechanism of the image forming apparatus. The mechanism includes a main motor (DC motor) 50 as a drive source, whose driving force is transmitted through first driving force transmission mechanism 51 to photosensitive drum 20.

More specifically, the driving force of driving gear 52, which is integral with the driving shaft of main motor 50, is transmitted to first gear 53 in mesh with gear 52, and then to third gear 55 via second gear 54 integral with gear 53. Subsequently, the driving force is transmitted to first toothed pulley 56 integral with third gear 55, and the driving force of pulley 56 is transmitted through first timing belt 57 to second toothed pulley 58. Further, the driving force is transmitted to gear 60, which is integral with photosensitive drum 20, via fourth gear 59 integral with pulley 58

Thus, the rotatory force of main motor 50 in either direction can be transmitted to photosensitive drum 20.

Gear 62, which is in mesh with fourth gear 59, is formed integrally with toner recovery auger 27*b*. The auger is used to carry out residual toner particles t, scraped off by means of cleaning blade 27*a* for use as a cleaning member of cleaning unit 27, into toner recovery box 61 (see FIG. 3). Auger 27*b* rotates in synchronism with the rotation of photosensitive drum 20.

The driving force is transmitted to developing unit 23, aligning roller pair 32, paper-supply roller 36, etc., via second driving force transmission mechanism 65, which shares part with first transmission mechanism 51. Moreover, the driving force is transmitted to fixing unit 33, exit roller pair 34, etc., via third driving force transmission mechanism 66, which also shares part with first transmission mechanism 51.

Second driving force transmission mechanism 65 is constructed in the following manner.

The driving force of toothed pulley 67 integral with first gear 53 is transmitted through timing pulley 68 to toothed pulley 69. The driving force of pulley 69 is transmitted through spring clutch 70 to coupling 71 for developing unit 23. Thus, the forward rotatory force of main motor 50 is transmitted to magnet roller 23*a*, developing agent auger 23*b*, and stirring auger 23*c* of unit 23.

Further, the driving force of toothed pulley 69 is transmitted to gear 73, which is in mesh with gear 72 integral with pulley 69. Furthermore, the driving force is transmitted successively to gears 75 and 76 via gear 74 integral with gear 73, and then to lower roller 32*a* of aligning roller pair 32 via spring clutch 77. Numeral 32*b* designates an upper roller of roller pair 32.

Toothed pulley 78 is formed integrally on gear 76 so that the driving force can be transmitted through timing belt 79 to the side of paper-supply roller 36.

Gear 76, out of gear train 80 including gears 72 to 76, is rotatably mounted inside lower unit lB of housing 1, and the other gears are located inside upper unit lA. One end of arm 82 is rockably mounted on pivot 81 of gear 74 for use as a first gear. Gear 75 for use as an intermediate gear, which is rotatably supported on the free end of arm 82, is always in mesh with gear 74. Intermediate gear 75, along with arm 82, can rock around pivot 81 in the directions to move toward and away from gear 76 for use as a second gear. Normally, gear 75 rocks by gravity, thereby engaging second gear 76.

The pressure angle between the respective tooth portions of intermediate gear 75 and second gear 76 is adjusted to a predetermined value such that gear 75 is subjected to a force in the direction to engage gear 76 when main motor 50 or first gear 74 forwardly rotates, and to a force in the direction to be disengaged from gear 76 when gear 74 reversely rotates. While photosensitive drum 20 is being forwardly rotated by means of motor 50, therefore, intermediate gear 75 of second transmission mechanism 65 is in mesh with second gear 76, so that the driving force is transmitted to aligning roller pair 32 as a driven member other than drum 20. While drum 20 is being reversely rotated, on the other hand, gear 75 is disengaged from gear 76, so that the driving force is cut off from roller pair 32.

Third driving force transmission mechanism 66 is constructed in the following manner. The driving force of gear 85 in mesh with third gear 55 is transmitted successively to gears 87 and 88 via gear 86 integral with gear 85, and then to heat roller 33*a* of fixing unit 33. Pressure roller 33*b* is pressed against roller 33*a* so as to rotate following to the rotation of roller 33*a*. Further, the driving force of gear 88 is transmitted successively through gears 89 and 90 to upper roller 34*a* of exit roller pair 34. A lower roller 34*b* is pressed against roller 34*a* so as to rotate following to the rotation of roller 34*a*.

Gears 87 and 88, out of gear train 94 including gears 52 to 55 and 85 to 88, is pivotally mounted inside lower unit lB of housing 1, and the other gears are located inside upper unit IA. One end of arm 93 is rockably mounted on pivot 92 of gear 55 for use as a first gear. Gear 91 for use as an intermediate gear, which is composed of integrally formed gears 85 and 86, is rotatably supported on the free end of arm 93. Gear 85 is always in mesh with first gear 55. Intermediate gear 91, along with arm 93, can rock around pivot 92 in the directions to move toward and away from gear 87 for use as a second gear. Normally, gear 91 rocks by gravity, so that gear 86 engages second gear 87.

The pressure angle between the respective tooth portions of gear 86 of intermediate gear 91 and second gear 87 is adjusted to a predetermined value such that gear 91 is subjected to a force in the direction to engage gear 87 when main motor 50 or first gear 55 forwardly rotates, and to a force in the direction to be disengaged from gear 87 when gear 55 reversely rotates. While photosensitive drum 20 is being forwardly rotated by means of motor 50, therefore, gear 86 of intermediate gear 91 of third transmission mechanism 66 is in mesh with second gear 87, so that the driving force is transmitted to heat roller 33*a* of fixing unit 33 and exit roller pair 34, as driven members other than drum 20. While drum 20 is being reversely rotated, on the other hand, gear 86 of intermediate gear 91 is disengaged from gear 87, so that the driving force is cut off from roller 33*a* and roller pair 34.

Figure 6:
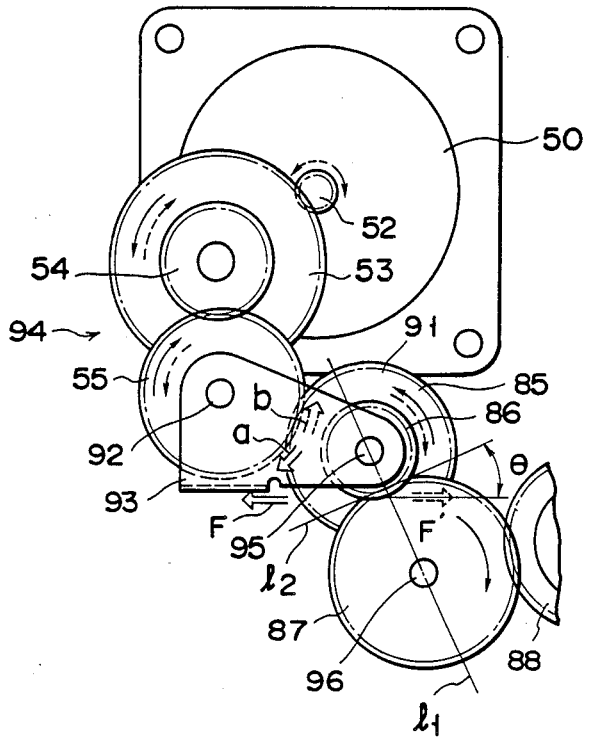

Referring now to FIG. 6, the reason why the driving force of intermediate gear 91 can be transmitted to second gear 87 only when main motor 50 rotates forward will be explained.

First, the relative positions of first gear 55, intermediate gear 91, and second gear 87 will be described. As mentioned before, intermediate gear 91 is mounted on the free end portion of arm 93 which is adapted to rock around pivot 92 of first gear 55, and engagedly lies on second gear 87, diagonally below first gear 55, by gravity. The pressure angle between gear 86 of intermediate gear 91 and gear 87 is set to 20° . If first gear 91 is urged to rotate in the forward direction indicated by the full-line arrow of FIG. 6, therefore, intermediate gear 91 is subjected to force F in a direction at angle of 20° to line 2, which passes through the junction of gear 86 of intermediate gear 91 and second gear 87, and extends perpendicular to line 1, which connects the respective centers 95 and 96 of rotation of gears 91 and 87. Thereupon, arm 93 is urged in the direction of arrow a, and gear 86 of intermediate gear 91 bites into second gear 87. Thus, the forward driving force of main motor 50 is transmitted to second gear 87.

If first gear 55 is urged to rotate in the reverse direction indicated by the broken-line arrow of FIG. 6, on the other hand, intermediate gear 91 is subjected to force F′ opposite to force F based on the aforesaid pressure angle. Thereupon, arm 93 is urged in the direction of arrow a opposite to the direction of arrow a. Accordingly, gear 86 of intermediate gear 91 cannot rotate second gear 87 which is subjected to the load of the driven members, and escapes from gear 87. Thus, when main motor 50 rotates in reverse, its driving force cannot be transmitted to second gear 87. Intermediate gear 75 of second driving force transmission mechanism 65 is also moved toward and away from second gear 76 by the same function as aforesaid.

In FIG. 4, dashed line L is a separation line which divides first or upper unit lA and second or lower unit lB of housing 1 of the image forming apparatus. Thus, when upper unit lA is swung up to the nonoperative position as shown in FIG. 3, intermediate gear 75 of second transmission mechanism 65 is separated from second gear 76 thereof, and intermediate gear 91 of third transmission mechanism 66 is separated from second gear 87 thereof. Since the respective intermediate gears of these two transmission mechanisms are supported on their corresponding arms so as to be rockable around the pivots of their corresponding first gears, they can be easily disengaged from their corresponding second gears when upper unit lA is swung open. When unit lA is lowered from the nonoperative position to the operative position, the intermediate gears go into contact with the corresponding second gears. At this time no impact great enough to damage the intermediate gears or the second gears is applied these gears since the arms, supporting the intermediate gears, are rotatable, and the intermediate gears can move upward a little.

In the image forming apparatus constructed in this manner, photosensitive drum 20 is cleaned in the following manner, by means of cleaning unit 27, during image forming operation.

Figure 7A:
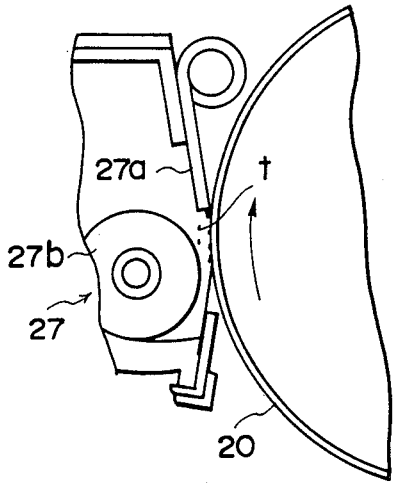
Figure 7B:
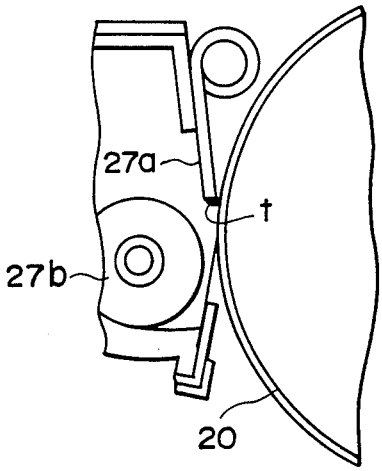
Figure 7C:
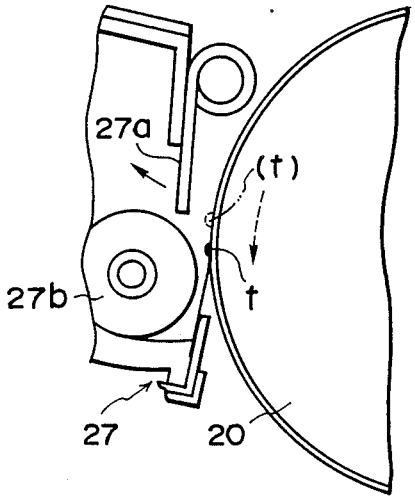
Figure 7D:
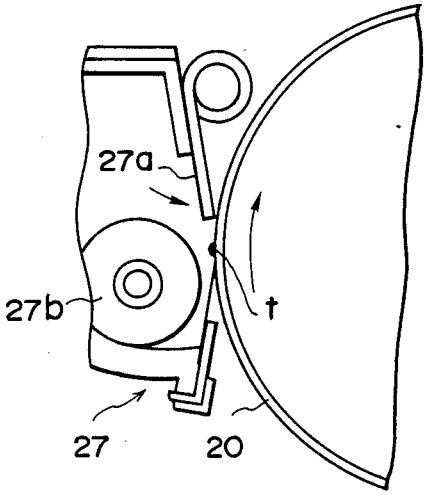

When photosensitive drum 20, during the image forming operation, is first rotated forward in the direction of the arrow, as shown in FIG. 7A, cleaning blade 27*a* of cleaning unit 27 abuts against the outer peripheral surface of the drum, thereby scraping residual toner particles t from the drum surface after image transfer. Scraped toner particles t are carried out into recovery box 61 by means of toner recovery auger 27*b*. Subsequently, when a final cycle of image forming operation ends, as shown in FIG. 7B, the rotation of photosensitive drum 20 is stopped. At this time, toner particles t remain on the end edge of blade *27a*. Thereafter, blade *27a* is rocked in the direction of the arrow to be disengaged from the surface of drum 20, as shown in FIG. 7C. Thus, the drum can be prevented from being damaged by continuous contact with the blade. The moment blade *27a* is rocked, photosensitive drum 20 is reversely rotated for a predetermined angle in the direction of the arrow, so that residual toner particles t, having so far been adhering to the end edge of blade *27a*, are moved to the upper-course side of the outer peripheral surface of the drum with respect to the blade. While drum 20 is reversely rotating, as mentioned before, the driving force of main motor 50 is not transmitted to the driven members other than the drum. When a subsequent cycle of image forming operation is started, blade *27a* abuts again against the outer peripheral surface of photosensitive drum 20, as shown in FIG. 7D, so that residual toner particles left after the image transfer, along with the toner particles moved from the blade edge to the drum surface, are scraped from the drum.

According to the image forming apparatus constructed in this manner, the intermediate gear of each of first and second driving force transmission mechanisms 65 and 66 of the drive mechanism is supported by the arm for rocking motion around the pivot of the first gear, in a manner such that the intermediate gear is moved toward the second gear when main motor 51 or photosensitive drum 20 forwardly rotates, and that the intermediate gear is moved in the direction away from the second gear when the drum reversely rotates. When drum 20 reversely rotates, therefore, the driving force can be cut off from the driven members other than the drum by means of a simple, low-priced arrangement, without using a spring clutch or the like. Thus, the operation of the image forming apparatus can be improved in reliability Further, the first gear and the intermediate gear, out of the gear train of each driving force transmission mechanism, are attached to upper unit 1A of apparatus housing 1, while the second gear is attached to lower unit 1B. Thus, in dividing or joining upper and lower units 1A and IB, the transmission mechanisms can be easily separated or securely connected without damaging the gears.

What is claimed is:

1. An image forming apparatus comprising:

a rotatable image carrier;

drive means including a drive source, for rotating the image carrier in a forward direction for image formation, and rotating the carrier in reverse for a predetermined amount after the image formation; and transmission means for transmitting the driving force of the drive source to a driven portion other than the image carrier when the carrier is being rotated forward and cutting off the driving force from the driven portion when the carrier is being rotated in reverse, said transmission means including a first gear rotated forwardly and reversely in synchronism with the image carrier by means of the drive source, a second gear in engagement with the driven portion, an intermediate gear in mesh with the first gear and capable of meshing with the second gear, and supporting means for supporting the intermediate gear so that the intermediate gear is subjected to a force in the direction for engagement with the second gear while the first gear is rotating forward, and the intermediate gear is subjected to a force in the direction for disengagement from the second gear while the first gear is rotating in reverse.

2. An apparatus according to claim 1, wherein said supporting means includes a supporting arm having one end portion supported for rocking motion around the center of rotation of the first gear and the other end portion supporting the intermediate gear for rotation.

3. An apparatus according to claim 2, wherein said first and second gears and said intermediate gear are arranged so that the intermediate gear moves to a position, in which the intermediate gear engages the second gear, by gravity when the drive means is not operating.

4. An apparatus according to claim 3, wherein the respective centers of rotation of said intermediate gear and said second gear ar situated below that of the first gear when the intermediate gear and the second gear are in mesh with each other.

5. An apparatus according to claim 2, wherein said intermediate gear and said second gear engage each other at a predetermined pressure angle.

6. An apparatus according to claim 1, which further comprises an apparatus housing including a first unit, holding the image carrier and the drive source, and a second unit, said first unit being movable relatively to the second unit, between an operative position, in which the first unit is in engagement with the second unit, and a nonoperative position, in which the first unit is disengaged from the second unit; and wherein said first gear and said intermediate gear of said transmission means are arranged in the first unit, and the second gear is arranged in the second unit, so that the intermediate gear is disengaged from the second gear thereof when the first unit is moved to the nonoperative position.

7. An apparatus according to claim 1, which further comprises cleaning means adapted to come into contact with the image carrier, for cleaning the carrier, during the image formation, and to be disengated from the carrier after the image formation.

8. An image forming apparatus comprising:

a rotatable image carrier;

drive means including a drive source, for rotating the image carrier in a forward direction for image formation, and rotating the carrier in reverse for a predetermined amount after the image formation;

driving force transmission mean for transmitting the driving force of the drive source to a driven portion other than the image carrier when the carrier is being rotated forward, and cutting off the driving force from the driven portion when the carrier is being rotated in reverse;

a first unit holding the image carrier and the drive means; and a second unit holding the driven portion, said first unit being movable between an operative position for image formation, in which the first unit is in engagement with the second unit, and a nonoperative position, in which the first unit is disengaged from the second unit, said transmission means including a first gear attached to the first unit and rotated forwardly and reversely in synchronism with the image carrier by the drive source, a second gear attached to the second unit and in engagement with the driven portion, an intermediate gear provided in the first unit, in mesh with the first gear, and capable of meshing with the second gear, and supporting means for supporting the intermediate gear so that the intermediate gear is subjected a force in the direction for engagement with the second gear while the first gear is forwardly rotating, and that the intermediate gear is subjected a force in the direction for disengagement from the second gear while the first gear is reversely rotating, wherein the intermediate gear and the second gear are disengaged from each other when the first unit is shifted to the nonoperative position.

* * * * *